United States Patent [19]

Beddome et al.

[11] 4,443,238

[45] Apr. 17, 1984

[54] RECOVERY OF HYDROGEN AND OTHER COMPONENTS FROM REFINERY GAS STREAMS BY PARTIAL CONDENSATION USING PRELIMINARY REFLUX CONDENSATION

[75] Inventors: Robert A. Beddome, Kenmore; John B. Saunders, Tonawanda; Gary W. Fenner, Grand Island, all of N.Y.

[73] Assignee: Union Carbide Corporation, Danbury, Conn.

[21] Appl. No.: 399,294

[22] Filed: Jul. 19, 1982

[51] Int. Cl.[3] ..... F25J 3/02

[52] U.S. Cl. ..... 62/17; 62/21; 62/39

[58] Field of Search ..... 62/16, 9, 11, 23, 21, 62/31, 17, 18, 20, 38, 39, 37; 202/198; 208/368; 196/138, 139

[56] References Cited

U.S. PATENT DOCUMENTS 3,205,669 9/1965 Grossman ..... 62/23

3,626,705 12/1971 Knapp et al. ..... 62/23

*Primary Examiner*—Frank Sever

*Attorney, Agent, or Firm*—Saul R Bresch

[57] ABSTRACT

Process for separating a hydrogen-containing refinery-type gas mixture into various fractions using reflux condensation, drying and partial condensation and phase separation.

5 Claims, 1 Drawing Figure

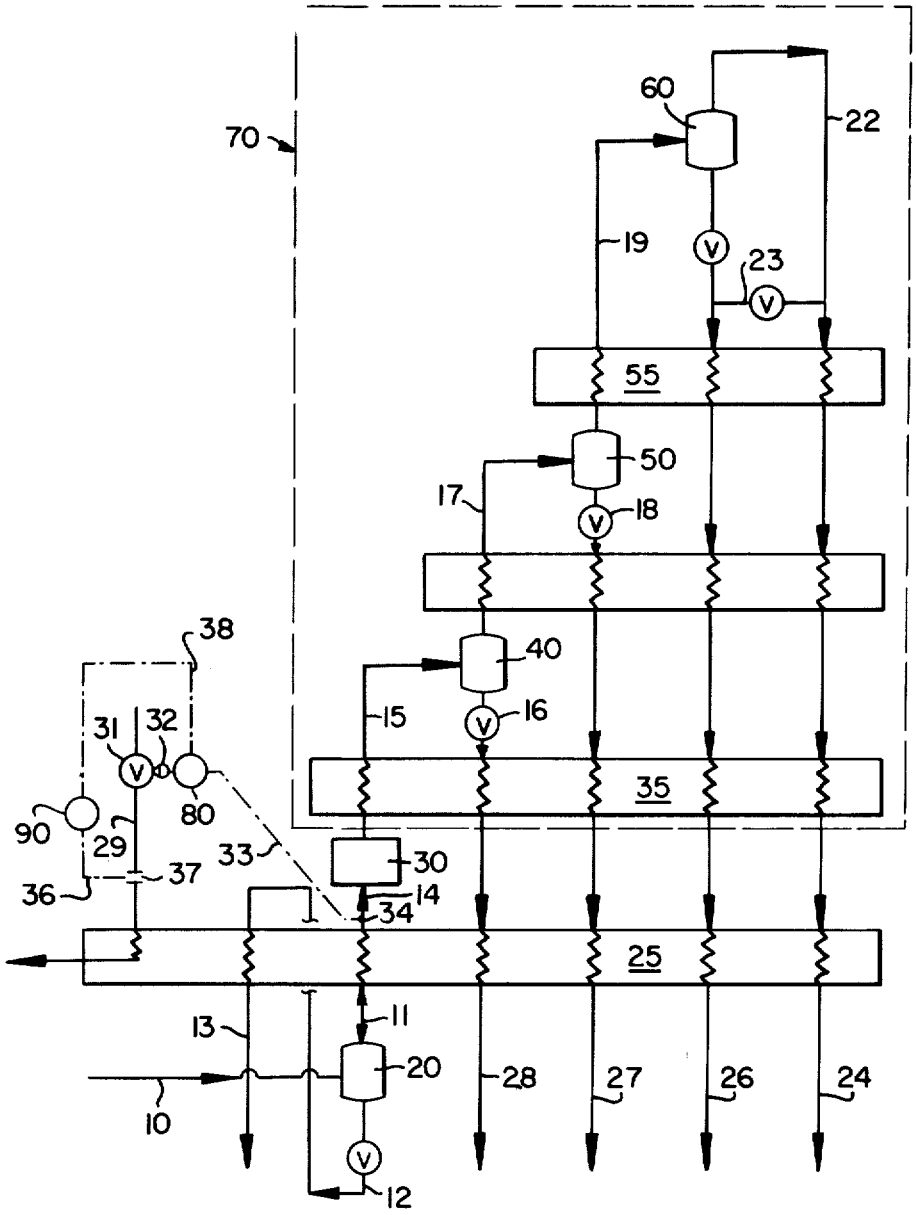
70
60
22
19
23
55
50
17
18
38
40
15
16
31
32
35
90
80
29
33
30
36
37
14
34
25
13
11
20
28
27
26
24
10
12

RECOVERY OF HYDROGEN AND OTHER COMPONENTS FROM REFINERY GAS STREAMS BY PARTIAL CONDENSATION USING PRELIMINARY REFLUX CONDENSATION

INTRODUCTION

The present invention relates to a cryogenic process for separating a hydrogen-containing refinery-type gas mixture into its various gas fractions. The gas mixture is processed through the steps of reflux condensation, drying, partial condensation, and phase separation. An important feature of this invention is its use of reflux condensation to remove, to suitably low levels, those hydrocarbon constituents of the gas stream that are likely to freeze in the cold sections of the cryogenic system. Generally, the most prevalent components in a refinery gas mixture posing a freezing problem for the cryogenic system are benzene, cyclohexane, and other hydrocarbons with freezing points above about −75° F. (213° K.).

BACKGROUND

This invention relates to a cryogenic process for recovering hydrogen and other components from a refinery-type gas mixture. The collection and separation of gases from various refinery operations, such as recovered from crude fractionation, thermal cracking, reforming, catalytic cracking, hydro-cracking, etc., are usually an important part of the overall operation of a petroleum refinery. Gas streams recovered from refinery operations usually contain numerous components of widely differing boiling points, including for example compounds such as hydrogen, methane, ethane, propane, butane, pentane, hexane, cyclohexane, benzene, toluene, and other saturated and aromatic hydrocarbon constituents. Many of these constituents are usually too valuable to be simply burned as plant fuel. For example, hydrogen finds widespread use in the refinery as a reactant, and its recovery can usually be justified.

It is well-known that successful hydrogen recovery by cryogenic techniques requires extremely low temperatures; temperatures on the order of 120° K. (−244° ) are typical. At these extremely low temperatures, most of the heavier components of the typical refinery gas mixture (i.e., those components with high boiling points) will solidify. Consequently, to avoid plugging in heat exchangers and process piping, the concentration of these heavier components must be reduced to very low levels prior to processing the refinery gas mixture at the low temperatures of the cryogenic separation.

In the past, a number of different processing techniques have been proposed for recovering hydrogen from refinery-type gas mixtures using cryogenic techniques. One particularly rudimentary procedure involved simply subjecting the gas mixture to a plurality of gas-liquid equilibrium separations at sequentially lower temperatures. In this way, the heavier, freezing-prone components of the gas mixture could be separated therefrom at the warmer temperatures of the process, and would thereby be prevented from reaching the colder regions of the separation system. Unfortunately, this approach is not only costly but is also sensitive to feed gas conditions, with concentration changes in the feed gas mixture (common with refinery-type gas streams), oftentimes precipitating process upsets.

The most recent approach prior to the present invention, involved an adsorptive pre-purification of the feed gas. In this system, the refinery gas mixture is passed through a compound absorption bed, containing activated carbon and molecular sieve. The gas is first passed through the carbon portion of the bed where the hydrocarbon components posing a problem for the subsequent cryogenic treatment are removed, and the gas is thereafter passed through the molecular sieve portion where primarily water is removed. Although this approach satisfactorily produces a dry, heavy hydrocarbon-free gas mixture suitable for cryogenic treatment, the energy demands of regeneration and the hydrocarbon components lost in the regeneration gas represent undesirable system costs.

In another prior art approach, the gases recovered from the various refinery operations are combined and fed to an absorber column wherein the heavier gas constituents are removed by contacting the gas with a lean oil; generally, a light oil (toluene) is used. The gas stream is thereafter dried and may then be subjected to conventional cryogenic hydrogen recovery techniques. The rich oil recovered from the absorber column may then be treated in an associated stripping column, which may use steam as the stripping gas, to regenerate the lean oil. This operation is not always suitable for preparing a refinery gas stream for cryogenic processing and relatively expensive from the standpoint of both equipment and operating costs.

In a further prior art approach methane and ethylene are condensed from a hydrogen feed stream in a reflux condenser and are used to wash out solid contaminants such as acetylene and carbon dioxide. The gas is introduced into the condenser at a temperature of about 165° K., and the uncondensed vapor is recovered as overhead at a temperature of about 150° K. Operation of the reflux condenser relies upon internally generated reflux.

It is an object of the present invention to provide an improved method for removing potentially freezable constituents from a refinery-type gas mixture which permits the direct recovery, as a separate stream, a major portion of its $C_5$+ hydrocarbon constituents.

It is a further object of this invention to provide a method for treating a refinery-type gas mixture that is generally lower in cost than alternate point art systems for accomplishing the same result.

These and other objects readily apparent to those skilled in this technology will become evident from the ensuing disclosure taken in conjunction with the drawing.

SUMMARY

The present invention relates to a method for removing a major portion of the $C_5$+ hydrocarbon content from a water-laden hydrocarbon-containing gas stream (i.e., a refinery-type gas mixture) in a cryogenic hydrogen recovery process comprising the steps of:

(a) pressurizing a water-laden, gas consisting essentially of hydrogen, methane, $C_2$, $C_3$, $C_4$, and $C_5$+ hydrocarbons at a pressure above about 400 psia, to provide a pressurized gas stream.

(b) passing the pressurized gas stream to a reflux condensation zone having a plurality of indirect heat exchange passages, (c) flowing the pressurized gas stream upwardly through some but not all of the plurality of passages of the reflux condensation zone in indirect heat exchange with a refrigerant stream flowing through other passages of the reflux condensation zone so as to partially condense the pressurized gas stream within the reflux condensation zone to generate to reflux liquid which flows downwardly in the plurality of the gas stream carrying passages to rectify the upwardly flowing pressurized gas, the reflux liquid gradually becoming enriched with $C_5+$ hydrocarbon constituents of the pressurized gas stream.

(d) controlling step (c) so that the partial condensation of the pressurized gas stream within the reflux condensation zone occurs at a temperature above about 240° K. (−30° F.), (e) separately recovering from the reflux condensation zone condensate liquid which contains a major portion of the $C_5+$ hydrocarbon content of the pressurized gas stream and uncondensed pressurized gas stream, (f) drying the water-laden pressurized gas stream prior to step (g) to provide an essentially water-free gas suitable for cryogenic processing, (g) further cooling the essentially water-free gas stream recovered in step (e) in a partial condensation zone to condense a major portion of the residual hydrocarbon constituents thereof and separating the unliquified gas and further cooling said unliquified gas to obtain a predominantly hydrocarbon residual condensate and a predominantly hydrogen unliquified gas product.

Preferably, to maximize energy efficiency, the following steps are also included:

(h) expanding the residual hydrocarbon condensate of step (g) to a pressure below about 60 psia and then rewarming at least part of the condensate by heat exchange with the cooling gas in the partial condensation zone and the reflux condensation zone, and (i) separately warming at least part of the unliquified gas product of step (g) by heat exchange with the cooling gas in the partial condensation zone of step (g) and the reflux condensation zone by step (c) and recovering the warmed gas as product.

In the broad practice of this invention, the water-laden, (e.g. from 100 ppm up to saturation) hydrocarbon-containing gas can be dried either before or directly after the reflux condensation step. Generally, an adsorptive process is used, typically employing a molecular sieve adsorbent. Preferably, the gas is dried directly after the reflux condensation step as this provides numerous benefits, as will be more clearly highlighted hereafter.

In a further refinement of this invention, an additional liquid stream, e.g., pentane, toluene, etc., can be added to the internally generated reflux of the reflux condensation zone to supplement the downward flow of liquid therein.

In a preferred practice (i.e., when the gas is dried after reflux condensation), operation of the reflux condensation zone is carefully controlled to avoid the formation of solid hydrates. Hydrate formation can be suppressed, for example, by methanol injection into the pressurized, water-laden, hydrocarbon-containing gas stream or by carefully controlling the cold end temperature of the reflux condenser. In this latter approach, an additional, controlled, source of refrigeration is provided for the reflux condensation zone. The flow of this additional refrigerant source is controlled so as to maintain the temperature of the remaining unliquified portion of the pressurized gas stream recovered from the reflux condensation zone above about 280° K. (45° F.).

As used in this invention, the term "refinery-type gas mixture" refers to a gas stream principally containing hydrogen (30 to 70 mole percent) and methane (15 to 50 mole percent), with varying, yet substantial, amounts of other constituents, such as ethane, propane and butane and minor, (0.25 to 5.0 mole percent) but significant in view of the subsequent cryogenic treatment, quantities of $C_5+$ saturated and aromatic components such as pentane, benzene, toluene, cyclohexane, xylene, etc. A gas mixture of this type is usually recovered from various unit operations in a petroleum refinery. Gas mixtures of this type may also be encountered in petrochemical facilities, and the gas mixtures may, in addition to the saturated and aromatic components also contain some unsaturated hydrocarbon constituents.

BRIEF DESCRIPTION OF THE DRAWINGS

FIG. 1 is a schematic representation of a preferred embodiment of the process of this invention.

DETAILED DESCRIPTION

Referring to FIG. 1, a water-laden gas stream at a flow rate of 1000 lb-mole/hr., at a pressure above about 400 psia (e.g., 640 psia) and at a temperature of about 316° K., is introduced into separator 20 through line 10. FIG. 1 illustrates a preferred embodiment of the present invention in which the water-laden gas is dried, e.g., to less than 100 ppm $H_2O$, after the step of reflux condensation. The pressurized gas stream may have the following representative composition on a water-free basis:

| | | Mole Percent | | Typical Range |
|---|---|---|---|---|
| | Hydrogen | 51.3 | | 30 to 70 |
| | Methane | 26.5 | | 15 to 50 |
| | Ethane | 11.6 | | 5 to 20 |
| | Propane | 4.75 | | 2 to 10 |
| | I—Butane | 2.62 | | 1 to 5 |
| | N—Butane | 1.29 | | 0.5 to 5 |
| $C_5+$ | I—Pentane | .920 | 1.50 | 0.25 to 5 |
| | N—Pentane | .115 | | |
| | Benzene | .026 | | |
| | Toluene | .009 | | |
| | Cyclohexane | .003 | | |
| | 2,3-Dimethylbutane | .003 | | |
| | N—Hexane | .006 | | |
| | N—Heptane | .303 | | |
| | M—Xylene | .112 | | |
| | Residual Gases | .443 | | |

The residual gases will generally include small amounts of nitrogen, carbon monoxide, carbon dioxide, and hydrogen sulfide. As will be recognized by one skilled in this technology, the temperatures used in the various steps of the invented method will be closely dependent upon the prevailing pressures, and both will be somewhat dependent upon the compositions of the gas streams being treated. Consequently, unless otherwise noted, the temperatures, pressures, and compositions recited in the ensuing disclosure of a specific embodiment are merely illustrative of the invention and are not meant to be limiting.

The gas stream at a temperature of about 316° K. is removed from separator 20 in line 11 and is introduced directly into the heat exchanger 25. Heat exchanger 25 will be referred to herein as a reflux condenser. It is also known in the art by other terms such as dephlegmator and trickle condenser. Any convenient heat exchanger design can be used by the reflux condenser 25, such as plate-type and tube-in-shell-type heat exchangers. A plate and fin design is presently preferred. In any event, the reflux condenser 25 has a plurality of heat transfer passages in indirect heat exchange relationship. In the reflux condenser 25, the gas flows upwardly through some of the passages in indirect heat exchange with a source of refrigeration. In the embodiment shown in FIG. 1, the gas is cooled by heat exchange with warming separated products to be described more fully hereafter, and with an extraneous refrigerant introduced through conduit 29. In this embodiment, a chilled water refrigerant system is used to provide a stream of 40° F. (278° K.) water as the extraneous refrigerant. Alternatively, a standard halogenated hydrocarbon refrigerant system, utilizing, e.g., a brine refrigerant cycle, could also be used.

In flowing upwardly through the reflux condenser 25, the pressurized gas stream is partially condensed. The condensate so-generated acts as a reflux liquid flowing downwardly in the same passages and rectifying the upwardly flowing gas. Consequently, the liquid gradually becomes enriched with the $C_5+$ constituents, and particularly those constituents of the pressurized gas stream most likely to freeze in the subsequent cryogenic separation. In this embodiment, the unliquified portion of the pressurized gas at a flow rate of about 970 lb/-mole/hr., is then recovered from the reflux condenser in line 14 at a temperature of about 283° K. (e.g., between 280° and 290° K.). The condensate is removed from reflux condenser 25 through conduit 11, the same passage used to introduce the pressurized gas stream into reflux condenser 25, and is subsequently recovered from separator 20 through valved conduit 12 at a flow rate of about 30 lb-mole/hr.

This liquid has the following composition on a water-free basis:

| | Mole Percent |
|---|---|
| Hydrogen | 2.15 |
| Methane | 5.97 |
| Ethane | 10.7 |
| Propane | 13.0 |
| I—Butane | 16.6 |
| N—Butane | 11.7 |
| $C_5+$ | 39.8 |
| Residual Gases | 0.08 |

As one can see, by processing the feed gas in the reflux condenser, the $C_5+$ hydrocarbon constituents of the pressurized gas stream have been increased in concentration from about 1.5 mole percent to about 40 mole percent in the liquid, at a recovery of about 80%. This liquid may be reduced in pressure, e.g., to about 25 psia, and may be reboiled in reflux condenser 25 to provide a portion of the refrigeration needed to condense the pressurized gas.

Although the specific concentrations of the various high boiling point components in the refinery gas mixture may be prone to rather wide variations, the overall or total content of these high boiling components in the gas mixture is generally rather stable. Consequently, the reflux condensation zone 25 typically tends to generate a rather uniform and stable flow of liquid or internal reflux. Owing to the high mutual solubility characteristics of these hydrocarbon components, this internally generated reflux liquid stream is able to safely and consistently remove the potentially freezable components of the refinery gas mixture to the required degree. However, in those cases where the internally generated liquid reflux is not sufficient to remove the high boiling components, e.g., when the gas stream has a relatively high benzene concentration, the present invention contemplates the addition of a supplementary liquid stream, e.g., toluene, to make up the deficiency.

In the FIG. 1 embodiment, the presence of water in the pressurized gas fed to the reflux condenser can lead to the undesirable formation of solid hydrates therein. To avoid hydrate formation, it is desirable to control the operation of the reflux condenser. One method for suppressing hydrate formation is to control the cold end temperature of the reflux condenser. In the FIG. 1 embodiment, this can be accomplished by monitoring the cold end temperature of the reflux condenser 25 with temperature sensing means 34. A signal indicative of this temperature is transmitted along line 33 to the controller 80. The controller in turn generates a signal, responsive to the measured temperature, which is transmitted along line 32 to valve 31 for controlling the flow rate of the extraneous refrigerant in conduit 29. A signal indicative of the flow rate is generated by flow recorder controller 90, based upon a measurement received via line 36 from orifice 37; this signal is transmitted to the controller 80 as a check against the flow rate setpoint. As an alternative to controlling the cold end temperature of reflux condenser 25, one may also inject methanol into the pressurized gas stream to suppress hydrate formation. The choice between these two alternatives should be made on a case-by-case analysis, as will be recognized by one skilled in this technology.

The unliquified portion of the pressurized gas conduit 14 is then dried in dryer 30. As in any cryogenic unit of this type, the gas stream must be completely dried to avoid water freezing in the partial condensation zone 70. Dryer 30 may be a 2-bed molecular sieve adsorption unit well-known in the art. The dryer section is preferably designed on the basis of the gas being saturated with water in its inlet condition. The gas is dried with one bed in service while the other is being regenerated. Molecular sieve dryers are generally preferred for this application since in addition to water, they are also able to remove any hydrogen sulfide present in the gas stream.

The positioning of the dryer system sequentially after the step of reflux condensation is generally preferred when implementing the present invention. If for example, one dries the pressurized gas stream prior to the step of reflux condensation, co-adsorption of aromatic and heavier aliphatic hydrocarbon constituents of the pressurized gas stream will generally interfere with the dryer's capacity for water; and more importantly, such co-adsorption may cause carbon deposition and gradual sieve degradation. Furthermore, the co-adsorbed hydrocarbon components are generally lost with the regeneration gas which is usually burned as plant fuel. Nevertheless, in the broad practice of this invention, the water-laden, pressurized stream can be dried either before or after the reflux condensation step. For instance, by positioning the dryer before the reflux condenser, one does avoid the potential problem by hydrate formation therein, even though other problems are created. Consequently, the positioning of the dryer will generally be the result of a case-by-case analysis of the various advantages and disadvantages of the alternative arrangements. As noted, however, it is believed that in most cases, it will be preferable to dry the water-laden pressurized gas after the reflux condenser. One advantage of this arrangement is that the reflux condenser helps to remove a large portion of the water content of the pressurized gas, thereby reducing the load on the dryer system. When the gas is dried after the reflux condenser, the temperature of the cold unliquefied gas existing the reflux condenser is maintained between about 280° K. and 290° K. If the gas is dried prior to the reflux condenser, it may be cooled to as low as 240° K. therein.

The dried, unliquified portion of the pressurized gas at about 240° K. is then passed to the partial condensation zone 70 for further cooling. In this embodiment, the partial condensation zone comprises a serial arrangement of heat exchangers and phase separators. The gas initially cooled in heat exchanger 35 to about 230° K. and is partially condensed. A first liquid fraction is then separated from the remaining unliquified gas in separator 40. The gas, at a flow rate of about 830 lb-moles/hr. having the following representative composition:

| | Mole Percent |
|---|---|
| Hydrogen | 61.0 |
| Methane | 29.4 |
| Ethane | 7.80 |
| Propane | 1.04 |
| I—Butane | 0.18 |
| N—Butane | Trace |
| $C_5^+$ | Trace |
| Residual Gases | 0.56 |

is then further cooled in heat exchanger 45 to about 150° K., and the second liquid fraction is separated from the unliquefied gas in separator 50. The remaining gas at a flow rate of about 630 lb-moles/hr. is then cooled further in heat exchanger 55 to about 122° K., and a third liquid fraction is separated from the unliquified gas in separator 60. The unliquified gas fraction recovered from separator 60 in line 22 comprises the hydrogen product and has the following representative composition:

| | Mole Percent |
|---|---|
| Hydrogen | 91.0 |
| Methane | 8.3 |
| Residual Gases | 0.7 |

This gas is sequentially warmed in heat exchangers 55, 45 and 35 and reflux condenser 25 and is then recovered as the hydrogen product in conduit 24. Hydrogen recovery from the original refinery gas stream is usually above 90%. Neglecting flow-related pressure losses, this gas can be recovered at essentially the same pressure as the refinery gas stream introduced through conduit 10.

The three liquid fractions recovered from separators 40, 50 and 60 are each reduced in pressure to about 25, 95 and 55 psia through valved conduits 16, 18 and 21, respectively. The liquid fractions are each throttled to a suitably low pressure so as to reduce their boiling points to below the temperature at which the unliquified gas is to be cooled in each of the respective heat exchangers. Preferably, a small quantity of product hydrogen is added to the throttled liquid from separator 60 through valved conduit 23 so as to further reduce the reboiling temperature of this particular liquid. In this way, the hydrogen purity of the hydrogen is maximized. Each of these liquid fractions is then rewarmed through the appropriate heat exchangers of the partial condensation zone and then through the reflux condenser 25, and each can be recovered as a separate product in conduits 28, 27 and 26, respectively.

The principal function of reflux condenser 25 is to remove, to suitably low levels, any hydrocarbon constituents of the pressurized gas stream that are likely to freeze in the cold sections of the cryogenic unit. In terms of a refinery gas mixture, the most likely candidates in this regard are benzene, cyclohexane, and other hydrocarbons with freezing points above about −75° K. (213° K.). In order to safely handle such potentially freezable components in a cryogenic system, their gas phase concentrations must be carefully controlled. In terms of this invention, the phrase "to suitably low levels" means that the gas phase concentrations of those components likely to freeze in the cryogenic unit are reduced such that their partial pressures in the gas phase are less than the vapor pressures of their pure component solid phases at the prevailing temperature. Otherwise, there should at least be a liquid phase associated with the gas which has a solubility for each freezable component above that necessary to dissolve the entire solid phase which would otherwise be formed at the prevailing conditions. As noted above, there are generally a sufficient diversity and quantity of hydrocarbon components in the pressurized gas stream to remove all of the potentially freezable constituents within the reflux condenser 25 to a satisfactorily low level for further cryogenic treatment. Nevertheless, if necessary, the addition of a small amount of a light oil, e.g., toluene, to the reflux condenser 25 can be used in certain cases to insure that the required degree of pretreatment is obtained.

As noted above, any convenient heat exchanger design can be used for the reflux condenser 25, for example, plate-type, plate and fin-type and tube-in-shell-type heat exchangers, although a conventional plate and fin heat exchanger is presently preferred. As described above, the pressurized feed gas mixture is flowed upwardly through a plurality of the passages in the reflux condenser 25, while liquid condensing therefrom flows downwardly in the same passages countercurrent to the gas flow. Refrigerant streams are then passed through the other passages of heat exchanger 25 in indirect heat exchange with the upwardly and downwardly flowing gas and liquid streams to remove the heat of condensation. To allow the countercurrent flow of liquid and gas through the same passages of the plate and fin heat exchanger, special care must be observed in its design. In particular, the cross-sectional flow area of the passages through which the gas and condensed liquid flow countercurrently to one another must be large enough to limit the gas flow velocity through the passages below that which would entrain the condensate. In this way, stable operation can be successfully maintained.

Although a preferred embodiment of the present invention has been described in detail, it should be appreciated that other embodiments along with various modifications of the disclosed features are contemplated, all being within the scope of this invention.

We claim:

1. A method for removing a major portion of $C_5+$ hydrocarbon content from a water-laden hydrogen and hydrocarbon-containing gas stream comprising the steps of:

(a) pressurizing a water-laden, gas consisting essentially of hydrogen, methane, $C_2$, $C_3$, $C_4$, and $C_5$+ hydrocarbons at a pressure above about 400 psia, to provide a pressurized gas stream, (b) passing the pressurized gas stream through separator means, adapted to permit the upward flow of gas simultaneously with the downward flow of liquid, to a reflux condensation zone having a plurality of indirect heat exchange passages, (c) flowing the pressurized gas stream upwardly through some but not all of the plurality of passages of the reflux condensation zone in indirect heat exchange with a refrigerant stream flowing through other passages of the reflux condensation zone so as to partially condense the pressurized gas stream within the reflux condensation zone, to generate a reflux liquid which flows downwardly in the plurality of the gas stream carrying passages to rectify the upwardly flowing pressurized gas, the reflux liquid gradually becoming enriched with $C_5$+ hydrocarbon constituents of the pressurized gas stream and being passed from said reflux condensation zone to said separator means and being collected from said separator means, (d) controlling step (c) so that the partial condensation of the pressurized gas stream within the reflux condensation zone occurs at a temperature above about 240° K. (−30° F.) with suppression of any hydrate formation, (e) separately recovering from the reflux condensation zone condensate liquid which contains a major portion of the $C_5$+ hydrocarbon content of the pressurized gas stream and uncondensed pressurized gas stream, (f) drying the water-laden pressurized gas stream prior to step (g) to provide an essentially water-free gas suitable for cryogenic processing, (g) further cooling the essentially water-free gas stream recovered in step (e) in a partial condensation zone to condense a major portion of the residual hydrocarbon constituents thereof and separating the unliquified gas and further cooling said unliquified gas to obtain a predominantly hydrocarbon residual condensate and a predominantly hydrogen unliquified gas product.

2. A method in accordance with claim 1 having the additional steps of:

(i) expanding the residual hydrocarbon condensate of step (g) to a pressure below about 60 psia and then rewarming at least part of the condensate by heat exchange with the cooling gas in the partial condensation zone and the reflux condensation zone, and (ii) separately warming at least part of the unliquified gas product of step (g) by heat exchange with the cooling gas in the partial condensation zone of step (g) and the reflux condensation zone by step (c) and recovering the warmed gas as product.

3. A method in accordance with claim 1 wherein the drying of step (f) is performed prior to step (b).

4. A method in accordance with claim 1 wherein the pressurized stream of step (a) is at a pressure above about 400 psia and is at a temperature of about 316° K.

5. A method in accordance with claim 1 wherein said water-laden gas comprises at least 30 mole percent hydrogen and at least 15 mole percent methane and up to 5 mole percent $C_5$+.

* * * * *

UNITED STATES PATENT AND TRADEMARK OFFICE

CERTIFICATE OF CORRECTION

PATENT NO. : 4,443,238

DATED : April 17, 1984

INVENTOR(S) : R.A. Beddone et al

It is certified that error appears in the above—identified patent and that said Letters Patent is hereby corrected as shown below:

At column 10, line 23, change "by" to --in--.

Signed and Sealed this

*Eleventh* Day of *September 1984*

[SEAL]

*Attest:*

GERALD J. MOSSINGHOFF

*Attesting Officer*

*Commissioner of Patents and Trademarks*